US012215690B2

(12) United States Patent
Busch

(10) Patent No.: US 12,215,690 B2
(45) Date of Patent: Feb. 4, 2025

(54) SCROLL COMPRESSOR FOR GENERATING OIL-FREE COMPRESSED AIR

(71) Applicant: OET GmbH, Lustenau (AT)

(72) Inventor: Christian Busch, Feldkirch (AT)

(73) Assignee: OET GmbH, Lustenau (AT)

( * ) Notice: Subject to any disclaimer, the term of this patent is extended or adjusted under 35 U.S.C. 154(b) by 0 days.

(21) Appl. No.: 18/266,901

(22) PCT Filed: Dec. 17, 2021

(86) PCT No.: PCT/EP2021/086441
§ 371 (c)(1),
(2) Date: Jun. 13, 2023

(87) PCT Pub. No.: WO2022/136157
PCT Pub. Date: Jun. 30, 2022

(65) Prior Publication Data

US 2024/0102470 A1 Mar. 28, 2024

(30) Foreign Application Priority Data

Dec. 21, 2020 (DE) ..... 102020134469

(51) Int. Cl.
*F04C 27/00* (2006.01)
*F04C 18/02* (2006.01)

(52) U.S. Cl.
CPC ..... *F04C 27/001* (2013.01); *F04C 18/0215* (2013.01)

(58) Field of Classification Search
CPC ..... F04C 27/001; F04C 18/0215; F04C 2210/221; F04C 18/0253; F04C 27/008
See application file for complete search history.

(56) References Cited

U.S. PATENT DOCUMENTS 4,890,987 A * 1/1990 Sato ..... F04C 28/16 417/310
6,592,345 B2 * 7/2003 Suefuji ..... F04C 27/008 418/55.4

(Continued)

FOREIGN PATENT DOCUMENTS

CN 111120308 A 5/2020
DE 102019200507 A1 7/2020

(Continued)

OTHER PUBLICATIONS

PCT Notification of Transmittal of the International Search Report and the Written Opinion of the International Searching Authority, or the Declaration, International Searching Authority, International Application No. PCT/EP2021/086441, mailed Apr. 21, 2022, 12 pages.

(Continued)

*Primary Examiner* — J. Todd Newton
(74) *Attorney, Agent, or Firm* — Cesari and McKenna, LLP

(57) ABSTRACT

A scroll compressor for generating oil-free compressed air, in particular for a compressed air brake system of a lorry, with a drive which is arranged in a housing and is connected to an orbiting displacer scroll which has a displacer scroll bottom and a displacer scroll wall. The displacer scroll wall engages into a stationary mating scroll, with the result that at least one variable compression chamber is formed between the displacer scroll and the mating scroll. A seal element is provided between the displacer scroll and the housing wherein the seal element is fastened in the displacer scroll bottom and seals against a sliding plate which is connected fixedly to the housing. A compressed air brake system with a scroll compressor of this type.

14 Claims, 3 Drawing Sheets

(56) References Cited

U.S. PATENT DOCUMENTS

| | | | | |
|---|---|---|---|---|
| 2002/0028150 | A1* | 3/2002 | Kawabata | F04C 18/0284 418/55.4 |
| 2002/0102174 | A1* | 8/2002 | Suefuji | F04C 27/008 418/55.4 |
| 2004/0105770 | A1* | 6/2004 | Sakamoto | F04C 18/0215 418/5 |
| 2005/0232799 | A1* | 10/2005 | Sato | F04C 27/008 418/55.6 |
| 2006/0254309 | A1* | 11/2006 | Takeuchi | F04C 29/0035 418/266 |
| 2008/0101973 | A1* | 5/2008 | Iwano | F04C 18/0261 418/55.1 |
| 2019/0285066 | A1* | 9/2019 | Klotten | F04C 27/008 |

FOREIGN PATENT DOCUMENTS

| | | | |
|---|---|---|---|
| DE | 10 2020 121 442 | A1 | 2/2022 |
| EP | 0798463 | A2 | 1/1997 |
| EP | 3372837 | A1 | 9/2018 |
| EP | 3848586 | A1 | 7/2021 |
| JP | H-02264180 | A | 10/1990 |
| JP | H-06159242 | A | 6/1994 |
| JP | 200182356 | A | 3/2001 |
| JP | 2006233934 | | 9/2006 |
| JP | 2015025387 | A | 2/2015 |
| JP | 202051339 | A | 4/2020 |

OTHER PUBLICATIONS

German Search Report, including machine translation, dated Nov. 5, 2021, German patent application No. 102020134469.4, 20 pages.

* cited by examiner

SCROLL COMPRESSOR FOR GENERATING OIL-FREE COMPRESSED AIR

CROSS REFERENCE TO RELATED APPLICATIONS

The present application is a National Stage of International Application No PCT/EP2021/086441, filed Dec. 17, 2021, which application claims priority to commonly owned German Patent Application No. 102020134469.4 filed Dec. 21, 2020 which applications are incorporated herein by reference in their entirety.

TECHNICAL FIELD

The invention relates to a scroll compressor for generating oil-free compressed air. The invention further relates to a compressed air brake system with a scroll compressor of this type.

BACKGROUND

Scroll compressors are known from prior art, and are used for various applications. For example, EP 0 798 463 A2 discloses a vacuum pump that is designed as a scroll compressor. The vacuum pump serves to evacuate containers, and is operated without oil. To this end, the vacuum pump has a scroll compressor, which has an orbiting displacer scroll that is connected with a drive and engages into a stationary mating scroll. The stationary mating scroll is fixedly integrated into a housing. The displacer scroll comprises a displacer scroll bottom and a displacer scroll wall, wherein the displacer is scroll wall engages into corresponding intermediate spaces of a mating scroll wall, so that a variable compression chamber is formed between the displacer scroll wall and the mating scroll wall.

In order to ensure gas tightness, a ring seal is provided in the housing, which seals against the displacer scroll bottom. In addition, the displacer scroll wall and the mating scroll wall each have scroll grooves, into which is placed a scroll seal, which seal against the displacer scroll bottom or the housing in the area of the bottom end of the mating scroll wall.

The displacer scroll orbits during the ongoing operation of the scroll compressor, meaning that it performs a circular motion over the ring seal. As a result, oil present in the drive segment of the scroll compressor can be conveyed from the displacer scroll over the ring seal, so that oil can penetrate into the compression chamber. In addition, the friction between the displacer scroll bottom and the ring seal can lead to an elevated wear on the ring seal, so that crossing passages for oil can form here as well.

As a consequence, the risk associated with the known scroll compressor is that the compression chambers are not kept completely free of oil. This is not critical during application as a vacuum pump, since the gas compressed in the compression chamber and any introduced oil are discharged into the environment. However, an oil input of this type is critical in a closed circuit, for example in compressed air brake systems, since the oil can accumulate in the closed gas circuit.

SUMMARY

The object of the invention is to indicate a scroll compressor for generating oil-free compressed air in which an input of oil into the compression area is efficiently prevented. The object of the invention is further to indicate a compressed air brake system with such a scroll compressor.

According to the invention, this object is achieved with respect to the scroll compressor by the subject matter of claim 1, and with respect to the compressed air brake system by the subject matter of claim 14.

The invention is thus based on the idea of indicating a scroll compressor for generating oil-free compressed air, in particular for a compressed air brake system of a lorry, with a drive that is arranged in a housing and connected with an orbiting displacer scroll. The displacer scroll has a displacer scroll bottom and a displacer scroll wall, wherein the displacer scroll wall engages into a stationary mating scroll, so that at least one variable compression chamber is formed between the displacer scroll and the mating scroll. According to the invention, a seal element is provided between the displacer scroll and the housing, wherein the seal element is fastened in the displacer scroll bottom and seals against a sliding plate, which is fixedly connected with the housing.

In order to ensure an efficient and permanent oil barrier between the drive area of the scroll compressor and the compression area of the scroll compressor, the invention provides that the seal element be fastened in the displacer scroll bottom and seal against a sliding plate, which is fastened in the housing. The sliding plate can here be designed in such a way as to achieve a good seal between the sliding plate and the seal element with little friction. This efficiently counteracts an excessive wear on the seal element, which in the long term leads to a high level of sealing.

In addition, arranging the seal element in the displacer scroll bottom increases the ease of maintenance for the scroll compressor according to the invention. Given a defect in the area of the seal, the seal can in this way be quickly renewed by changing out the entire displacer scroll, including the seal arranged therein. Additional hand movements are required in prior art to change out the seal element in the housing after dismantling the displacer scroll. In the invention, this can be done easily and quickly by changing out the displacer scroll with integrated seal element. As a result, the scroll compressor is ready for use again within a short time.

In a preferred embodiment of the invention, the sliding plate has a harder material than the housing, at least in a contact area with the seal element. Moreover, the sliding plate can have a lower roughness on a side facing the seal element than surfaces of the housing. Therefore, the sliding plate essentially serves on the one hand to provide a good contact with the seal element, and on the other to reduce the friction between the sliding plate and the seal element. Since the seal element orbits with the displacer scroll, meaning moves over the sliding plate, the harder material of the sliding plate in this area prevents or reduces wear on the seal element. In this regard, the sliding plate, in particular with the harder material in the contact area with the seal element, forms a basis for a good and in particular oil-free seal between the drive area of the scroll compressor and the compression area. This ensures that oil will not get from the drive area into the compression area. Consequently, this ensures that the generated compressed air is free of oil.

A scraping element for stripping oil residues from the sliding plate can further be fastened in the displacer scroll bottom as an additional safety barrier. The scraping element is preferably arranged parallel or concentric to the seal element, and acts to strip oil residues that can become deposited on the sliding plate in the contact area with the seal element. This ensures that areas of the sliding plate that are routinely arranged in the compression area do not introduce oil into the compression area. Areas such as these come about, since the orbiting motion of the displacer scroll establishes a contact area on the sliding plate that is arranged temporarily in the compression area and temporarily in the drive area. The scraping element strips any oil that might have been deposited on this contact area of the sliding plate, so that sections of the sliding plate that get into the compression area are free of oil.

In order to fixedly receive the seal element and/or the scraping element in the displacer scroll, a preferred variant of the invention provides that the displacer scroll bottom have a seal groove for receiving the seal element and/or a scraper groove for receiving the scraping element. Additional preloading elements can be arranged in the seal groove and/or scraper groove, and extend between a groove bottom and the seal element or the scraper element. These preloading elements produce a contact pressure of the seal element or scraper element on the sliding surface, and thereby ensure a permanent seal or stripping function, including in particular even if the seal element and/or scraper element are somewhat worn.

In addition, a sliding element can be arranged between the displacer scroll and the sliding plate. The sliding element can be designed as an axial bearing, and support the displacer scroll against the sliding plate or against the housing. The sliding element preferably has a material that slides especially well on the sliding plate. In particular, the sliding element together with the sliding plate yields a reduced friction between the displacer scroll and housing, so that an easy rotation of the displacer scroll sets in. This reduces the energy expenditure for operating the scroll compressor, as well as the frictional heat that arises during operation.

The sliding element can be arranged in a recess in the displacer scroll bottom. On the one hand, the sliding element is resultantly well fixed at the predetermined position. On the other hand, the sliding element can in this way be easily changed out together with the displacer scroll, for example for repair purposes.

In order to further improve the sliding properties of the sliding element, it is provided that the sliding element be arranged radially inside of the seal element and/or the scraping element. Therefore, the sliding element can essentially be arranged in the oil-lubricated area, in particular in the drive area, of the scroll compressor. Oil lubrication thus additionally takes place between the sliding element and sliding plate, which leads to a smooth rotation of the displacer scroll.

The scroll compressor according to the invention can further provide that guide pins be anchored in the housing, and extend through openings in the sliding plate into the guide rings arranged in the displacer scroll bottom. The guide pins each have a ledge that projects over the sliding plate, so that a distance exists between the respective guide ring and the sliding plate. The combination of guide pin and guide ring is referred to as a "pin-ring" system, which is advantageous for the orbiting motion of the displacer scroll. The guide pin engaging into the guide ring forces the displacer scroll into the predetermined orbit, which an eccentric bearing of the displacer scroll generates on the shaft of the drive.

In order to keep friction as low as possible here as well, it is advantageously provided that the guide pins have the ledge that projects over the sliding plate. This creates a distance between the guide ring and the sliding plate, so that the friction in this area is reduced. In addition, the distance between the guide ring and sliding plate enables an oil lubrication of the sliding plate.

An especially preferred embodiment of the invention provides that the drive be arranged between a first displacer scroll and a second displacer scroll. The scroll compressor can thus be designed as a multistage, in particular two-stage, scroll compressor. In this way, a pre-compression can take place in a first compression stage, and a post-compression in a second compression stage, so that especially high pressures can be achieved. This makes sense in particular while generating compressed air for compressed air brake systems, in particular in lorries.

In this regard, a preferred variant also provides that the drive have a shaft with two shaft ends, wherein a first shaft end is connected with the first compressor scroll, and a second shaft end is connected with the second displacer scroll. The displacer scrolls hence share the same drive, which increases the efficiency of the scroll compressor, and advantageously reduces its size. This type of two-stage scroll compressor is thus especially compact.

The first compressor scroll can here form a first compressor stage with a first mating scroll, and the second compressor scroll can form a second compressor stage with a second mating scroll. The compressor stages can be coupled with each other, for example so that the first compressor stage enables a pre-compression, and the second compressor stage a post-compression. This makes it possible to achieve especially high pressures, which during the generation of compressed air make sense in particular for compressed air brake systems of lorries. The first compressor stage can be coupled with the second compressor stage via external lines. However, it is also possible to integrate the lines for coupling the two compressor stages into the housing of the scroll compressor. In any event, it is preferably provided that a heat exchanger be arranged between the first compressor stage and the second compressor stage, which dissipates heat from the pre-compressed compressed air, so that cooled, pre-compressed compressed air is supplied to the second compressor stage.

In particular, it can be provided that the first compressor stage perform a compression from a suction pressure to a medium air pressure. For example, the suction pressure can here measure about 1 bar, while the medium air pressure lies within a range of 3.5 bar to 4 bar. The second compressor stage can then perform a higher compression from a medium air pressure to a high air pressure. Therefore, the medium air pressure, which preferably measures between 3.5 bar and 4 bar, is compressed to a high air pressure within a range of about 14 bar.

The first shaft end and the second shaft end are preferably each equipped with a radial bearing, in particular an eccentric bearing. The radial bearing or eccentric bearing can be designed as a plain bearing, ball bearing or needle bearing. A respective compensation mechanism can be arranged between the first shaft end and the first displacer scroll and/or between the second shaft end and the second displacer scroll, which reduces vibrations and a noise development resulting therefrom during the orbiting motion of the displacer scroll. This type of compensation mechanism comprises a compensation mass, which is eccentrically arranged on the axis of rotation of the orbiting displacer scroll, and can swing around this axis of rotation. The compensation mechanism is here configured in such a way that the swinging adjusts itself automatically based on existing centrifugal forces. The compensation mechanism here produces a compensation of gas forces and production tolerances, which reduces vibrations and noise development during scroll compressor operation.

For example, a compensation mechanism that can especially preferably be used for the scroll compressor according to the invention is described in the subsequently published Patent Application 10 2020 121 442.1, the contents of which are referenced in their entirety, in particular in connection with the exemplary embodiment therein according to FIG. 2.

Another variant of the invention provides that a respective scroll seal be provided between the displacer scroll wall and the mating scroll, as well as between the mating scroll wall and the displacer scroll. As a result, the displacer scroll and the mating scroll are well sealed against each other, so that a closed, essentially leak-free variable compression space forms. The scroll seal can here also compensate for production tolerances and pressure fluctuations in the compression chamber. In this regard, the scroll compressor can make do without a counterpressure chamber or back-pressure chamber, which normally uses the pressure from the compression space to press the orbiting displacer scroll against the mating scroll Eliminating the counterpressure chamber saves on installation space, which makes the scroll compressor especially compact.

A first scroll seal is preferably arranged in a scroll groove of the displacer scroll wall, which is open toward the mating scroll. A second scroll seal can be arranged in a scroll groove of the mating scroll wall that is open toward the displacer scroll. Therefore, it is essentially provided that the scroll grooves receive and fix the respective scroll seal in both the displacer scroll wall and the mating scroll wall. In order to reduce friction between the displacer scroll and the mating scroll, a thrust washer can be allocated to each scroll seal. The thrust washer is preferably arranged between the respective scroll seal and the displacer scroll or the mating scroll, and in this way reduces the friction between the displacer scroll and mating scroll. The thrust washer is here forced by the scroll seal against the respective displacer scroll or mating scroll, thereby yielding a sealing function on the one hand, and a sliding function on the other.

A preferred variant of the scroll compressor according to the invention provides that the drive and/or the housing and/or the mating scroll be cooled by water. Water cooling is especially efficient, and enables a high and rapid heat dissipation, so that the scroll compressor can be operated at especially high pressures. This is especially expedient in particular for compressed air brake systems of lorries. In the cooling process, special attention can be placed on the housing, in particular on the high-pressure or outlet side of the scroll compressor. The high-pressure compression can lead to especially high temperatures in this area, meaning in particular in the area of the second compressor stage, which can be readily dissipated through water cooling. In addition, it makes sense to cool the compressed air generated in the scroll compressor. For this purpose, a heat exchanger is preferably provided between the first compressor stage and the second compressor stage, which dissipates heat from the compressed air compressed to a medium air pressure. In this way, precooled medium pressure air gets into the second compressor stage, in which the medium pressure air is further compressed into a high pressure air.

A secondary aspect of the invention relates to a compressed air brake system, in particular of a lorry, with a scroll compressor described above. However, these types of compressed air brake systems can be used not only in lorries, but also in buses or working machines, such as dredgers, rollers, self-driving cranes, and the like. In any event, this type of compressed air brake system is especially suitable for vehicles with an overall mass exceeding 5 tons.

BRIEF DESCRIPTION OF THE DRAWINGS

The invention will be explained in more detail below based on an exemplary embodiment with reference to the attached schematic drawings. Shown therein are.

DESCRIPTION

Figure 1:
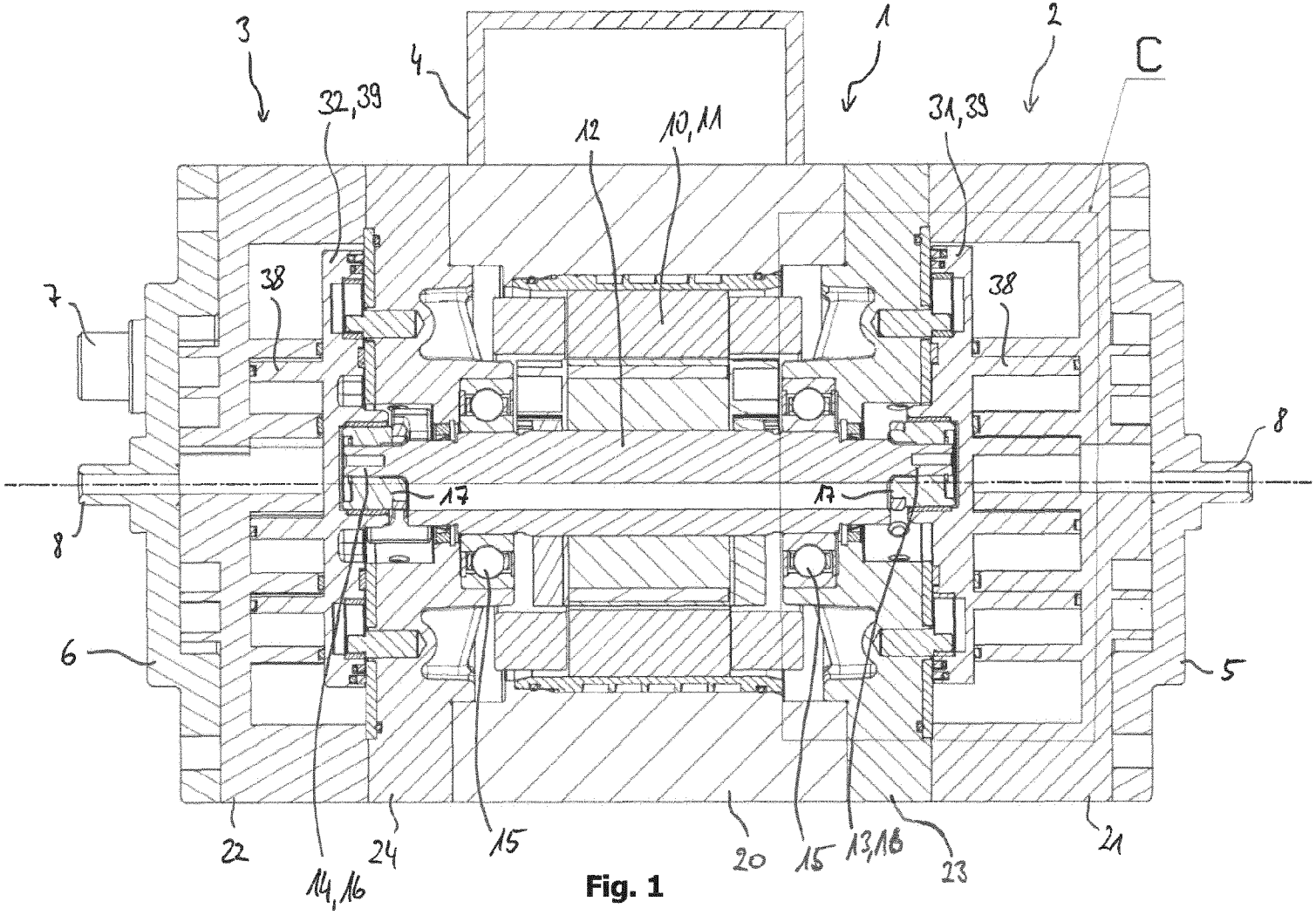
FIG. 1 a cross sectional view through a scroll compressor according to the invention based on a preferred exemplary embodiment.

The scroll compressor according to FIG. 1 is designed as a two-stage compressor. For this purpose, the scroll compressor has a central drive segment 1, which is axially connected on both sides to a respective compressor segment 2, 3. A first compressor segment 2 is here designed as a first compressor stage, and the second compressor segment 3 as a second compressor stage. The first compressor segment 2 serves to compress an ambient air pressure to a medium air pressure, wherein the second compressor segment 3 compresses the medium air pressure to a high air pressure.

The drive segment 1 comprises the drive 10, which comprises an electric motor 11 and a shaft 12. The electric motor 11 is arranged inside of a housing 4, which is multipart in design for ease of maintenance. The housing 4 comprises a drive housing 20, two bearing housings 23, 24 that connect to the drive housing 20, mating scrolls 21, 22 that likewise form parts of the housing 4, and end covers 5, 6. As a consequence, a first bearing housing 23 connects to the drive housing 20 in the direction of the first compressor segment 2. The first bearing housing 23 is fixedly connected with the first mating scroll 21, which likewise forms part of the housing 4. The first mating scroll 21 is followed by the first end cover 5, which axially closes the housing 4. A second bearing housing 24 is arranged on the opposite side of the drive housing 20, and connected with a second mating scroll 22. The second mating scroll 22 is long axially covered by a second end cover 6.

The shaft 12 is mounted in the drive housing 20 by shaft bearings 15. The shaft 12 has a first shaft end 13, which is directed toward the first compressor segment 2. Further provided is a second shaft end 14, which faces the second compressor segment 3. Both shaft ends 13, 14 each have an eccentric pin 16, which is arranged in an eccentric bearing 17 that establishes the connection to the respective displacer scroll 31, 32. Therefore, the first displacer scroll 31 is mounted on the eccentric pin 16 of the first shaft end 13 via the eccentric bearing 17. The second displacer scroll 32 is mounted on the eccentric pin 16 of the second shaft end 14 via the eccentric bearing 17.

The displacer scrolls 31, 32 each have a displacer scroll bottom 39, from which a displacer scroll wall 38 extends into the respective mating scroll 21, 22. This will be exemplarily explained below based on FIG. 2, which shows a cutout of the second compressor segment 3 of the scroll compressor according to FIG. 1. The design described below for the first compressor segment 2 applies analogously to the second compressor segment 3. The first displacer scroll 31 and the second displacer scroll 32 as well as the first mating scroll 21 and the second mating scroll 22 are thus similarly constructed, in particular also with regard to their arrangement relative to each other. They only differ in terms of the volume of a compression chamber 30 formed between them, which in the second compressor stage, meaning between the second displacer scroll 32 and the second mating scroll 22, is smaller than in the first compressor stage, i.e., between the first displacer scroll 31 and the first mating scroll 21.

Figure 2:
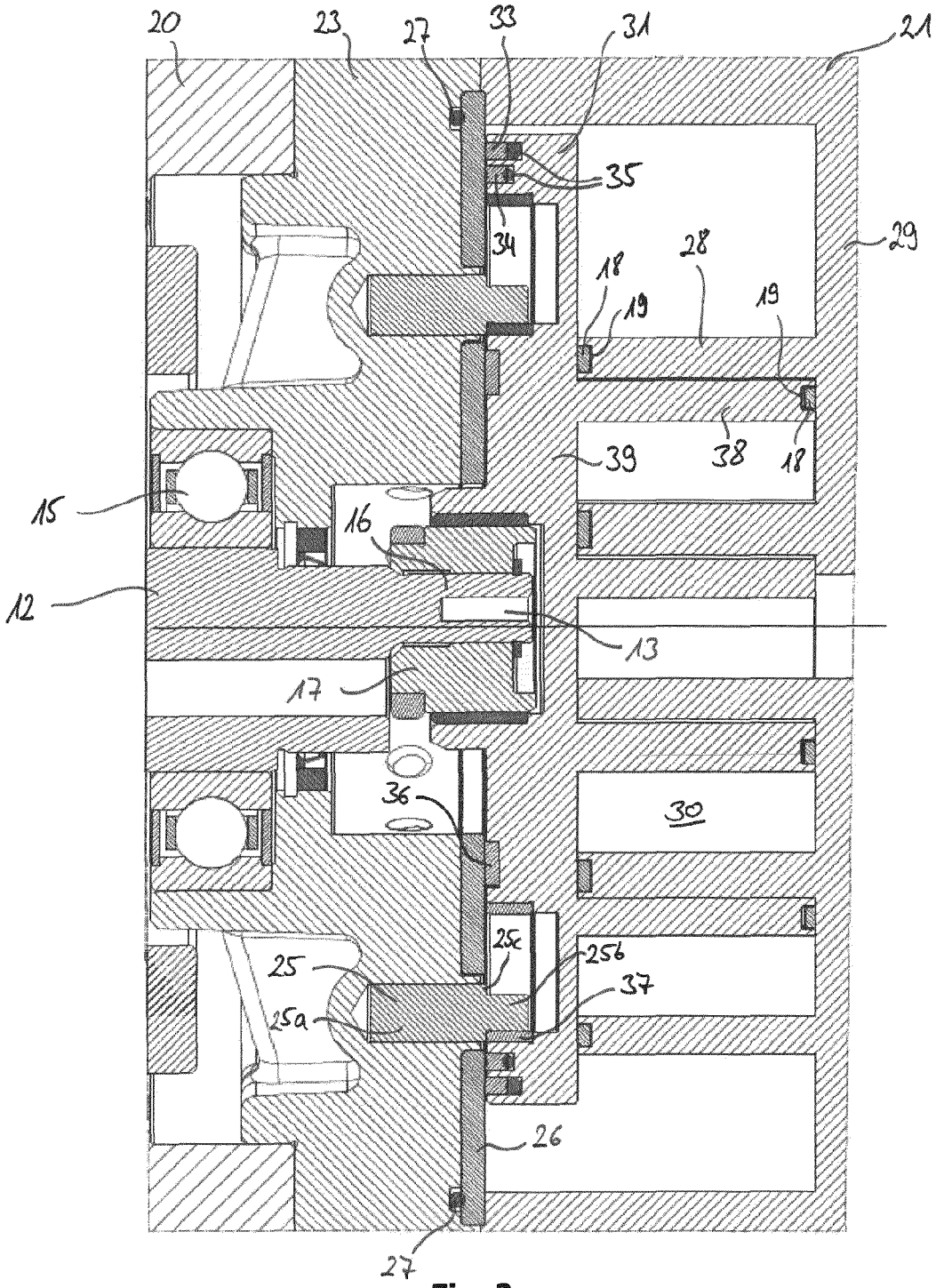
FIG. 2 a detail C of the scroll compressor according to FIG. 1.

Therefore, FIG. 2 shows the first displacer scroll 31, which comprises a displacer scroll bottom 39 and a displacer scroll wall 38. The first displacer scroll 31 engages into the first mating scroll 21, so that the compression chamber 30 is formed between the displacer scroll wall 38 and a mating scroll wall 28. The compression chamber 30 is variable, meaning that the orbiting motion of the first displacer scroll 31 changes the volume of the compression chamber 30, thereby performing a compression of the gas located in the compression chamber 30, preferably air.

In order to effectively seal the first displacer scroll 31 and the first mating scroll 21 against each other, it is provided that the first displacer scroll 31 and the first mating scroll 21 each have a scroll groove 19, in which a scroll seal 18 is arranged. The scroll seal 18 of the first displacer scroll 31 here forms a seal against a mating scroll bottom 29 of the first mating scroll 21. By contrast, the scroll seal 18 of the first mating scroll 21 forms a seal against the displacer scroll bottom 39. The scroll seals can each comprise thrust washers, which are arranged between the respective scroll groove 19 and the displacer scroll bottom 39 or the mating scroll bottom 29.

In order to guide the first displacer scroll 31 into the orbiting motion, several guide rings 37 are arranged in the displacer scroll bottom 39. The guide rings 37 accommodate guide pins 25, which are fixed in the first bearing housing 23. Each guide pin 25 comprises an anchoring section 25*a*, which is held in a corresponding hole of the first bearing housing 23. A guide section 25*b* of the guide pin 25 engages into the guide ring 37. A ledge 25*c* is formed between the guide section 25*b* and the anchoring section 25*a*. In particular, the ledge 25*c* is formed by virtue of the guide section 25*b* having a smaller diameter than the anchoring section 25*a*.

The anchoring section 25*a* is preferably not completely recessed into the corresponding hole of the first bearing housing 23. Rather, the ledge 25*c* of the anchoring section 25*a* protrudes over the first bearing housing 23. The guide ring 37 rests on the ledge 25*c*. Since the ledge 25*c* protrudes over the first bearing housing 23, a distance is formed between the guide ring 37 and a sliding plate 26 that is fixed in the first bearing housing 23. As a result, oil that lubricates the drive segment can flow between the guide ring 37 and the sliding plate 26, and thereby lubricate the sliding plate 26.

The sliding plate 26 is preferably ring-shaped in design, and comprises through holes through which the guide pins 25 can extend. The sliding plate 26 can be sealed with a ring seal 27 on a side facing the first bearing housing 23. The ring seal 27 is here arranged in a continuous groove in the first bearing housing 23.

The first displacer scroll 31 rests on the sliding plate 26 with a sliding element 36. Specifically, a sliding element 36 in the form of a sliding ring is provided radially inside of the guide pins 25, and arranged in a groove in the displacer scroll bottom 39. The sliding element 36 can protrude slightly over the displacer scroll bottom 39, so that essentially only the sliding element 36 slides on the sliding plate 26. As a consequence, the displacer scroll bottom 39 is spaced a distance apart from the sliding plate 26. The sliding element 36 preferably also serves as an axial bearing for the first displacer scroll 31. The sliding element 36 is here lubricated with liquid, preferably lubricated with oil. In general, the shaft bearings 15 can also be lubricated with oil. However, it is also possible that the shaft bearings 15 be lubricated with grease.

A sealing system is provided to prevent oil from getting out of the drive segment 1 and into the first compressor segment 2. The sealing system comprises a seal element 33 and a scraping element 34. The seal element 33 and the scraping element 34 are each ring-shaped in design, and fastened in corresponding ring grooves in the first displacer scroll 31. As evident on FIG. 2, a respective preloading element 35 is arranged in the ring grooves that hold the scraping element 34 or the seal element 33. The preloading element 35 is arranged between the seal element 33 or the scraping element 34 and a groove bottom of the respective groove in the displacer scroll bottom 39, and pushes the seal element 33 or the scraping element 34 against the sliding plate 26. The scraping element 34 here serves to strip away oil that accumulates on the sliding plate 26. The seal element 33 prevents any oil that might not have been stripped away from getting into the area flooded with compressed air, in particular the compression chamber 30.

Figure 3:
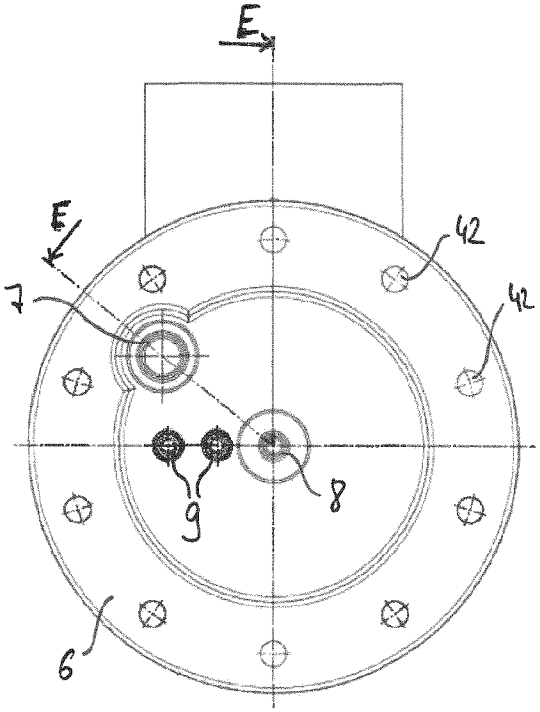
FIG. 3 a front view of the scroll compressor according to FIG. 1.

FIG. 3 shows a front view of the scroll compressor, in particular the second end cover 6. The first end cover 5 is preferably identical in design, making it possible to reduce production costs.

The respective end cover 5, 6 comprises several fastening holes 42, which are arranged regularly distributed over the circumference of the end cover 5, 6. The fastening holes make it possible to fix the end cover 5, 6 on the respective mating scroll 21, 22, for example by means of screws.

Each end cover 5, 6 further has an air inlet 7 and an air outlet 8. The air inlet 7 is connected with an entrance area of the compression chamber 30. The air outlet 8 is connected with an exit area of the compression chamber 30. Cooling ports 9 are further provided on the end cover 5, 6 so that the scroll compressor can be cooled with water. The cooling ports 9 make it possible to hook up a cooling water pump, so as to form a closed cooling water circuit inside of the housing 4.

Figure 4:
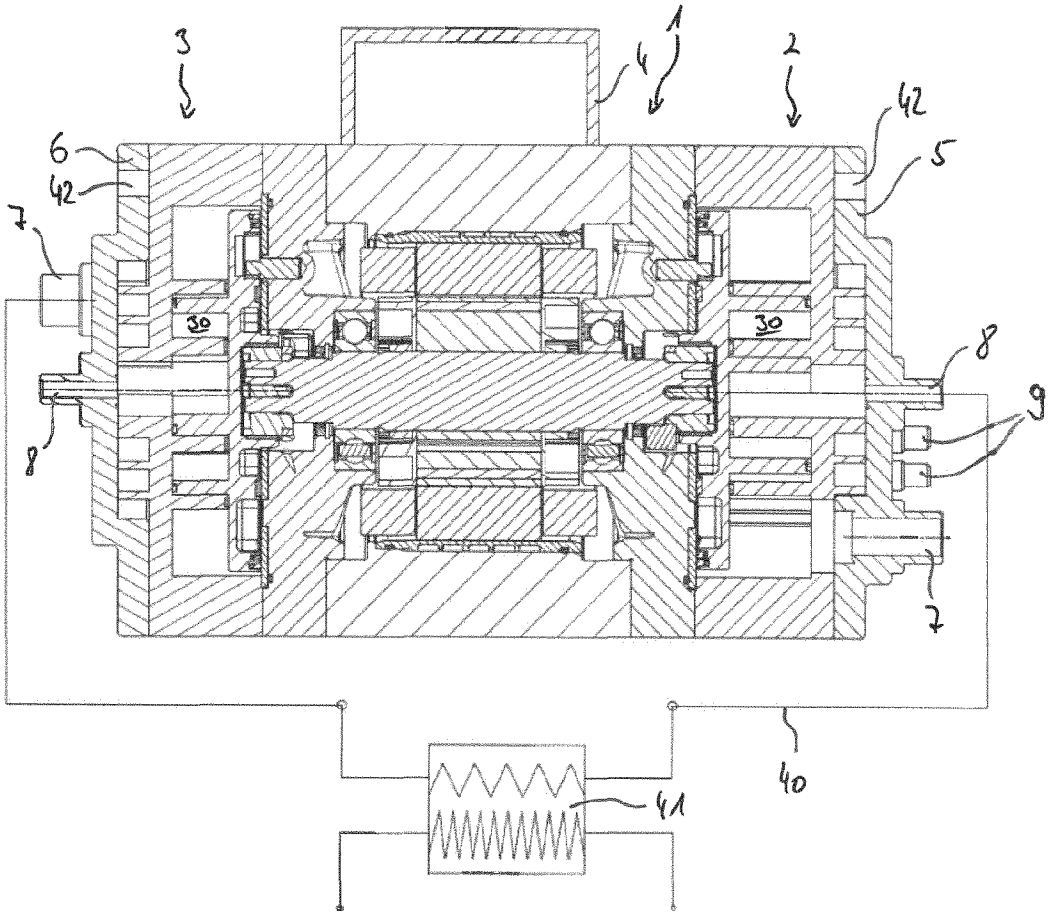
FIG. 4 a sectional view of the scroll compressor according to FIG. 1 along line E-E on FIG. 3.

FIG. 4 shows a section through the scroll compressor along the E-E line on FIG. 3. The section hence does not run along a straight line as a cross section through the scroll compressor, for example like the cross section according to FIG. 1. Given the special sectional progression along the E-E line, the air inlet 7 can thus also be discerned on FIG. 4 in the area of the first compressor segment 2, while it cannot be seen in the cross sectional view according to FIG. 1.

The sectional view according to FIG. 4 is intended to illustrate how the two compressor stages or compressor segments 2, 3 interact with each other. It is provided that the first compressor segment 2 perform a precompression of the air flowing into the compression chamber 30 of the first compressor segment 2 via the air inlet 7 in the first end cover 5. The air is initially compressed to a medium air pressure in the first compressor segment 2, and transferred to a compressed air line 40 via the air outlet 8 in the first end cover 5.

The air is strongly heated by the compression in the first compressor segment 2. In order to prevent the scroll compressor from becoming overheated, it is additionally provided for purposes of water cooling via the cooling ports 9 that the pre-compressed medium pressure air be guided via a heat exchanger 41. For this reason, the heat exchanger 41 is provided in the compressed air line 40, so as to extract heat from the medium pressure air and transfer it to another fluid circuit, which can be filled with gas or liquid.

The medium pressure air cooled in this way then passes through the air inlet 7 in the second end cover 6 and into the compression chamber 30 of the second compressor segment 3. As evident on FIG. 4, the compression chamber 30 of the second compressor segment 3 has a smaller volume than the compression chamber 30 of the first compressor segment 2, so as to further compress the medium pressure air to a high-pressure air. The high-pressure air exits the second compressor segment 3 via the air outlet 8 in the second end cover 6, which is preferably connected with a compressed air brake system of a lorry.

Specifically, the scroll compressor can be configured in such a way that air with an air pressure of 1 bar applied to the air inlet 7 of the first end cover 5 be pre-compressed in the first compressor segment 2 (first compressor stage) to a medium air pressure of between 3.5 and 4 bar, and post-compressed in the second compressor segment 3 (second compressor stage) to a high air pressure of about 14 bar. Before being fed into the second compressor segment 3, the medium pressure air with a medium air pressure of 3.5 to 4 bar is guided via the compressed air line 40 to the heat exchanger 41, and there cooled to prevent the second compressor segment 3 from overheating.

REFERENCE LIST

1 Drive segment
2 First compressor segment
3 Second compressor segment
4 Housing
5 First end cover
6 Second end cover
7 Air inlet
8 Air outlet
9 Cooling port
10 Drive
11 Electric motor
12 Shaft
13 First shaft end
14 Second shaft end
15 Shaft bearing
16 Eccentric pin
17 Eccentric bearing
18 Scroll seal
19 Scroll groove
20 Drive housing
21 First mating scroll
22 Second mating scroll
23 First bearing housing
24 Second bearing housing
25 Guide pin
25*a* Anchoring section
25*b* Guide section
25*c* Ledge
26 Sliding plate
27 Ring seal
28 Mating scroll wall
29 Mating scroll bottom
30 Compression chamber
31 First displacer scroll
32 Second displacer scroll
33 Seal element
34 Scraping element
35 Pre-loading element
36 Sliding element
37 Guide ring
38 Displacer scroll wall
39 Displacer scroll bottom
40 Compressed air line
41 Heat exchanger
42 Fastening hole

What is claimed is:

1. A scroll compressor for generating oil-free compressed air comprising:

a drive arranged in a housing and connected with one or more orbiting displacer scrolls, each displacer scroll having a displacer scroll bottom and a displacer scroll wall, wherein the displacer scroll wall engages into one or more stationary mating scrolls, so that at least one variable compression chamber is formed between a respective one of the one or more orbiting displacer scrolls and a respective one of the one or more stationary mating scrolls, wherein a seal element is provided between the respective displacer scroll and the housing, and wherein the seal element is fastened in a respective displacer scroll bottom and seals against a sliding plate fixedly connected with the housing, wherein a scraping element for stripping oil residues from the sliding plate is fastened in each displacer scroll bottom.

2. The scroll compressor according to claim 1, wherein the sliding plate has a harder material than the housing, at least on a contact area with the seal element.

3. The scroll compressor according to claim 1, wherein the respective displacer scroll bottom has a seal groove for receiving the seal element and a scraper groove for receiving the scraping element.

4. The scroll compressor according to claim 1, wherein a sliding element is configured and arranged between the respective displacer scroll and the sliding plate.

5. The scroll compressor according to claim 4, wherein the sliding element is arranged radially inside of the seal element and the scraping element.

6. The scroll compressor according to claim 1, wherein guide pins are anchored in the housing and extend through openings in the sliding plate into guide rings configured and arranged in the displacer scroll bottom, wherein each guide pin has a ledge that projects over a respective sliding plate, so that a distance exists between a respective guide ring and the sliding plate.

7. The scroll compressor according to claim 1, wherein the drive is configured and arranged between a first displacer scroll and a second displacer scroll.

8. The scroll compressor according to claim 7, wherein the drive has a shaft including a first shaft end connected with the first displacer scroll and a second shaft end connected with the second displacer scroll.

9. The scroll compressor according to claim 7, wherein the first displacer scroll forms a first compressor stage with a first mating scroll, and wherein the second displacer scroll forms a second compressor stage with a second mating scroll.

10. The scroll compressor according to claim 1, wherein one or more scroll seals is provided between the displacer scroll wall and the respective mating scroll, as well as between a mating scroll wall and the respective displacer scroll.

11. The scroll compressor according to claim 10, wherein a first scroll seal is configured and arranged in a first scroll groove of the displacer scroll wall that is arranged to open toward the respective mating scroll, and wherein a second scroll seal is configured and arranged in a second scroll groove of the mating scroll wall that is arranged to open toward the respective displacer scroll.

12. The scroll compressor according to claim 1, wherein the drive, the housing, and the respective mating scroll are cooled by water.

13. A compressed air brake system comprising:

a scroll compressor configured to generate oil-free compressed air, the scroll compressor including a drive arranged in a housing and connected with one or more orbiting displacer scrolls, each displacer scroll having a displacer scroll bottom and a displacer scroll wall, wherein the displacer scroll wall engages into one or more stationary mating scrolls, so that at least one variable compression chamber is formed between a respective one of the one or more orbiting displacer scrolls and a respective one of the one or more stationary mating scrolls, wherein a seal element is provided between the respective displacer scroll and the housing, and wherein the seal element is fastened in the displacer scroll bottom and seals against a sliding plate fixedly connected with the housing.

14. A vehicle having an air brake system comprising:

a scroll compressor configured to generate oil-free compressed air, the scroll compressor including a drive arranged in a housing and connected with one or more orbiting displacer scrolls, each displacer scroll having a displacer scroll bottom and a displacer scroll wall, wherein the displacer scroll wall engages into one or more stationary mating scrolls, so that at least one variable compression chamber is formed between a respective one of the one or more orbiting displacer scrolls and a respective one of the one or more stationary mating scroll, wherein a seal element is provided between the respective displacer scroll and the housing, and wherein the seal element is fastened in the displacer scroll bottom and seals against a sliding plate fixedly connected with the housing.

* * * * *